US007513977B2

(12) United States Patent
Koerner et al.

(10) Patent No.: US 7,513,977 B2
(45) Date of Patent: Apr. 7, 2009

(54) COKE DRUM AUTOMATED DRILL STEM GUIDE AND COVER SYSTEM

(75) Inventors: Andre Koerner, Missouri City, TX (US); Mark Taylor, Houston, TX (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 468 days.

(21) Appl. No.: 11/255,486

(22) Filed: Oct. 21, 2005

(65) Prior Publication Data

US 2006/0086539 A1 Apr. 27, 2006

Related U.S. Application Data

(60) Provisional application No. 60/622,182, filed on Oct. 26, 2004.

(51) Int. Cl.
*C10B 43/00* (2006.01)

(52) U.S. Cl. ..... 202/241; 202/242; 202/250; 202/262; 408/80; 408/11

(58) Field of Classification Search ..... 202/242, 202/241, 239, 250, 262; 408/1, 80, 11; 134/22.18; 201/2, 41

See application file for complete search history.

(56) References Cited

U.S. PATENT DOCUMENTS 5,022,799 A * 6/1991 Torres et al. ..... 408/1 R
5,259,930 A * 11/1993 Barker et al. ..... 201/2
5,846,034 A * 12/1998 Martin et al. ..... 408/1 R
6,050,277 A * 4/2000 Purton et al. ..... 134/167 R
6,228,225 B1 * 5/2001 Meher-Homji ..... 202/250
7,037,408 B2 * 5/2006 Wilborn et al. ..... 201/2
7,112,261 B1 * 9/2006 TerWisscha et al. ..... 201/2
7,117,959 B2 * 10/2006 Lah ..... 175/67
2003/0127314 A1 * 7/2003 Bell et al. ..... 202/262
2004/0253066 A1 * 12/2004 Paul ..... 408/124

* cited by examiner

*Primary Examiner*—N. Bhat
(74) *Attorney, Agent, or Firm*—Pearne & Gordon LLP

(57) ABSTRACT

A drill stem guide and cover system is designed to guide a drill stem used in coke cutting operations. After a cutting tool and drill stem are inserted into a coke drum, covers close, forming a passageway small enough that it prevents the cutting tool on the end of the drill stem from being removed but large enough to allow movement of the drill stem. The drill stem moves within the passageway to allow the cutting tool to be raised and lowered as needed. The closed covers provide protection from the release of pressurized or explosive gases while the coke cutting operation is taking place. The covers can be automated so that an operator can control them from a safe distance, and the covers can be remotely opened for the removal of the drill stem and cutting tool when coke cutting operations are not taking place.

31 Claims, 14 Drawing Sheets

COKE DRUM AUTOMATED DRILL STEM GUIDE AND COVER SYSTEM

CROSS-REFERENCE TO RELATED APPLICATIONS

This application claims the benefit of U.S. Provisional Application Ser. No. 60/622,182, filed Oct. 26, 2004, which is incorporated by reference in its entirety.

BACKGROUND OF THE INVENTION

1. Field of the Invention

The present invention relates to the field of delayed coker units and more particularly, a system for covering the coke drum of a Delayed Coker Unit (DCU) and providing a drill stem guide.

2. Description of the Related Art

Conventional manual top unheading, makeshift or impromptu drill stem guides and often absent or crude covers have been used during DCU top unheading and coke cutting operations.

There are now several coke drum top unheading valves available in the commercial industrial market but only a few in use. Most DCUs continue to use manually bolted top heads and therefore manual top unheading. Many DCUs use some form of a drill stem guide collar but other installations do not. Drill stem guides seen on DCUs range from very crude contraptions built as an afterthought to more carefully constructed devices.

Somewhat similarly, a wide variety of top head covers, built for various purposes depending on the DCU operating conditions and requirements, are also seen. These covers are also typically simple and basic coverplates that are pinned or manually bolted to the top head and do not include any technique for controlled actuation or movement.

BRIEF SUMMARY OF THE INVENTION

According to one embodiment, a drill stem guide assembly for insertion of a drill stem into a coke drum for coke cutting operations comprises a plurality of covers, which are moveable between an open and a closed position, each of which comprises a guide section; a mounting frame configured to attach the plurality of covers; and a plurality of actuators disposed on the mounting frame to move the plurality of covers between the open position and the closed position, where the guide sections form a passageway for guiding the drill stem as the drill stem is moved within the coke drum.

In a further embodiment, the guide section is made of a material softer than the drill stem. In another further embodiment, a control system is configured to communicate with the plurality of actuators. In a yet further embodiment, the control system is configured to communicate with a limit switch, wherein the limit switch is triggered by the plurality of covers when the plurality of covers is not in the closed position. In another yet further embodiment, the control system is further configured to control a cutting tool disposed on the drill stem.

In another further embodiment, a limit switch, which is triggered by the plurality of covers when the plurality of covers is not in the closed position, is disposed on the mounting frame. In another yet further embodiment, the limit switch is configured to communicate with a control system. In another yet further embodiment, the control system is further configured to control a cutting tool disposed on the drill stem.

In another further embodiment, a shield is disposed on a first cover of the plurality of covers such that the shield overlaps a portion of the first cover and a portion of a second cover of the plurality of covers when the plurality of covers is in the closed position. In another further embodiment, a maintenance cradle, wherein the maintenance cradle is detachable, is configured to hold and support a cutting tool.

According to another embodiment, a drill stem guide assembly for insertion of a drill stem into a coke drum for coke cutting operation comprises a first cover, moveable between an open position and a closed position, with a first guide section; a second cover, with a second guide section; a mounting frame configured to attach the first cover and the second cover to the coke drum; and a plurality of actuators mounted with the mounting frame to move the first cover between the open position and the closed position, wherein the first guide section and the second guide section form a passageway for guiding the drill stem as the drill stem is moved within the coke drum.

In a further embodiment, the guide section is made of a material softer than the drill stem. In another further embodiment, a control system is configured to communicate with the plurality of actuators, and a limit switch, which is attached to the mounting frame, is configured to communicate with the control system, wherein the limit switch is triggered by the plurality of covers when the plurality of covers is not in the closed position. In another yet further embodiment, the control system is configured to communicate with a high pressure water supply of a cutting tool. In another further embodiment, a shield is disposed on a first cover such that the shield overlaps a portion of the first cover and a portion of a second cover when the plurality of covers is in the closed position. In another further embodiment, a maintenance cradle, configured to hold and support a drill stem cutting tool, is removably positionable with the first cover and the second cover.

According to another embodiment, a drill stem guide assembly for insertion of a drill stem into a coke drum for coke cutting operation comprises a plurality of covers moveable between an open position and a closed position, each of the plurality of covers comprising a guide section; and a plurality of actuators configured to communicate with a plurality of covers so as to move the plurality of covers between the open position and the closed position, wherein the guide sections of the plurality of covers form a passageway for guiding the drill stem as the drill stem is moved within the coke drum when the covers are in the closed position.

In another further embodiment, the guide section is made of a material softer than the drill stem. In another further embodiment, the drill stem guide assembly comprises a mounting frame. In a yet further embodiment, a limit switch is disposed on the mounting frame, wherein the limit switch is triggered by the plurality of covers when the plurality of covers is not in the closed position and is configured to communicate with a control system, wherein the control system is further configured to control a high pressure water supply of a cutting tool disposed on the drill stem. In another further embodiment, a control system is configured to communicate with the actuators, wherein the control system is configured to communicate with a limit switch disposed on one of the plurality of covers, and the limit switch is configured to signal the control system to shutdown a high pressure water supply of a cutting tool when the limit switch is triggered, wherein the limit switch is triggered when the plurality of covers is not in the closed position. In another further embodiment, a shield is disposed on a first cover of the plurality of covers such that the shield overlaps a portion of the first cover and a portion of a second cover of the plurality of covers when the plurality of covers is in the closed position. In another further embodiment, a maintenance cradle, which is removably positionable with the plurality of covers, is configured to hold and support a drill stem cutting tool.

According to another embodiment, a coke cutting system comprises a plurality of covers moveable between an open position and a closed position, wherein each of the plurality of covers further comprising a guide section; a mounting frame configured to attach the plurality of covers; a plurality of actuators disposed on the mounting frame to move the plurality of covers between an open position and a closed position, wherein the guide sections of the plurality of covers form a passageway for guiding a drill stem as the drill stem is moved within the coke drum when the plurality of covers is in the closed position; a drill stem adapted for raising and lowered a rotatable nozzle disposed on the end of the drill stem into and out of the coke drum; a rotation motor attached to the drill stem for rotating the rotatable nozzle; a motor for raising and lowering the drill stem; and a high pressure water supply in fluid communication with the drill stem.

In another further embodiment, the guide section is made of a material softer than the drill stem. In another further embodiment, a control system is configured to communicate with the plurality of actuators; and a limit switch is configured to communicate with the control system, wherein the limit switch is triggered by the plurality of covers when the plurality of covers is not in the closed position. In another further embodiment, the control system is configured to communicate with the motor for raising and lowering the drill stem, wherein the control system is configured to communicate with a gate valve operator and with a drill stem travel limit switch, wherein the drill stem travel limit switch prevents the motor for raising and lowering the drill stem from lowering the drill stem if the gate valve operator is in the closed position. In another further embodiment, a limit switch is disposed on the mounting frame, wherein the limit switch is triggered by the plurality of covers when the plurality of covers is not in the closed position. In a yet further embodiment, the limit switch is configured to communicate with a control system, and the control system is configured to communicate with the high pressure water supply of the rotatable nozzle. In another further embodiment, a shield is disposed on the first cover of the plurality of covers such that the shield overlaps a portion of the first cover and a portion of a second cover of the plurality of covers when the plurality of covers is in the closed position. In another further embodiment, a maintenance cradle, which is removably positionable with the plurality of covers, is configured to hold and support the rotatable nozzle.

BRIEF DESCRIPTION OF THE SEVERAL VIEWS OF THE DRAWINGS

A better understanding of the present invention can be obtained when the following detailed description of various disclosed embodiments is considered in conjunction with the following drawings, in which.

DETAILED DESCRIPTION OF THE INVENTION

Figure 1:
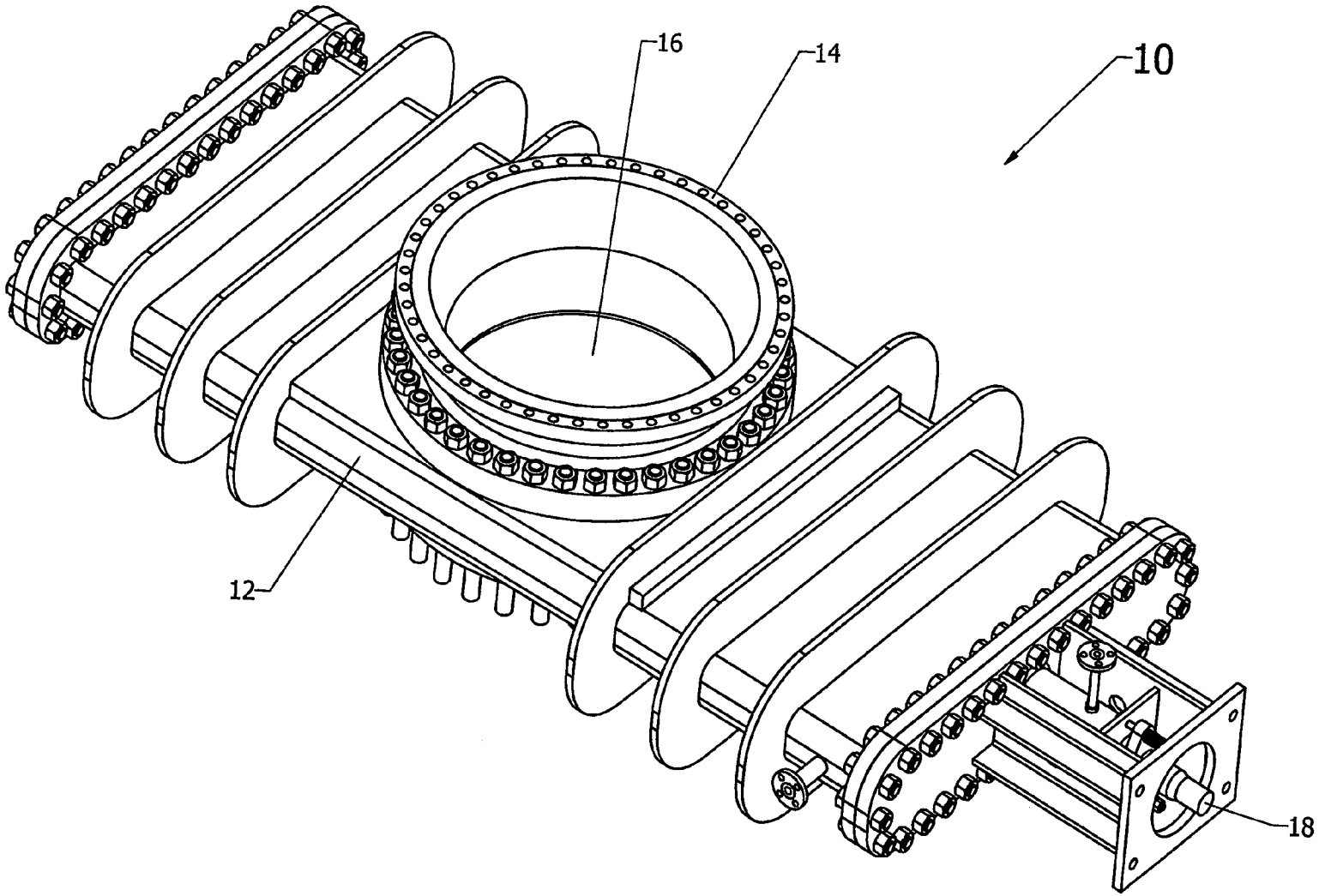
FIG. 1 is a perspective view illustrating a conventional gate valve as used for coke drum top unheading service, with the valve shown in the closed position.

Delayed Coker Unit (DCU) top unheading and coke cutting are highly specialized functions in the refining industry. A brief and simple explanation of these operations is necessary to acquaint the reader, and those not specifically trained in the art, with the delayed coking process so as to better understand the application and novel features of the disclosed embodiments of the present invention.

In past decades, most operations in petroleum refining have been fully developed and proceed continuously while Delayed Coking remains one of few batch-continuous operations. The delayed coker treats heavy gas oil (HGO) or "crude bottoms" feedstock to recover any remaining light hydrocarbons and to produce solid coke, a low grade commercial fuel that is often burned with gas or fuel oil for power generation. HGO is continuously pumped to a fired heater where the temperature is raised to approximately 500 degC. [930 degF.]. The hot feedstock is next filled at a pressure of about 2.8 barg [40 psig] to one of a pair (or more) of large vertical coke drums approximately 7.6 m [25 ft] in diameter and 24 m [80 ft] high. The heavy feedstock is cracked or coked at this temperature and pressure, splitting off and vaporizing lighter hydrocarbons that are recovered and transferred to the refinery product stream for further processing and leaving solid coke (relatively pure carbon) in the drum as the material cools. After all available light hydrocarbons are removed, the amorphous coke formation in the drum is cooled to near ambient pressure and temperature in preparation for unheading and coke cutting to empty it from the drum. While one drum is being coked, cooled and cut, other drums can be filled to repeat this batch operation every 12 to 20 hours depending on drum size, production rate, feedstock and other process parameters.

Unheading is the term for removing the sealing or cover blind flanges from the top and bottom drum nozzle connections or heads. The bottom head is typically 1.5 m [60"] in diameter while the top is 0.9 m [36"]. In many DCUs today, unheading refers to simply manually unbolting and removing the sealing flanges, often aided by a variety of mechanical systems to support and convey the large heavy flanges. Recently, large remotely operated gate valves and automated flange removal systems are replacing simply bolted flanges in unheading service to limit or eliminate coker personnel exposure to this dangerous environment and potentially hazardous work.

Coke cutting or "cutting the drum" is the use of high pressure (300 barg [4500 psig]) water jets emanating from a slowly rotating drilling tip or cutting tool that is lowered and cuts through the coke bed or tree-like solid coke formation. This action breaks apart and dislodges pieces of coke that fall out the bottom opening or head. Cutting tools, also known as hydraulic coke removal tools, were originally developed by William Court in 1938 under U.S. Pat. No. 2,245,554, which is incorporated by reference in its entirety for all purposes, and have been continually improved thereafter. The Pacific Combination Tool of U.S. Pat. No. 4,275,842, which is incorporated by reference in its entirety for all purposes, exemplifies today's cutting tool technology that is commercially marketed by the Flowserve Corporation, Vernon, Calif. Coke thus loosened or cut from the drum may be discharged to a pit underneath the drum, loaded directly into railcars or moved by conveyor to a storage area. To reach through to the bottom of the drum, the cutting tool is typically suspended from the end of a long drill stem or pipe, typically longer than the drum is high, hanging above the coke drum in a drilling derrick structure. Initially a 800 to 900 mm [30" to 36"] diameter pilot hole is cut through the center of the coke formation to provide an opening for the drill stem and cutting tool, discharge cutting water and allow loose coke to fall through and out of the drum. The cutting tool is next withdrawn to the top and out of the drum, the water jet nozzles switched to cutting mode or aimed outward and lowered down into the bottom of the drum. Next the funnel shaped cone area at the bottom of the drum is cut to allow free flow of loose coke out the bottom head. Finally, outward facing high pressure water jets break apart the remaining coke formation from the bottom up, and the coke flows out of the drum until it is empty. There are variations to this cutting procedure, but most proceed in this general fashion.

Figure 2:
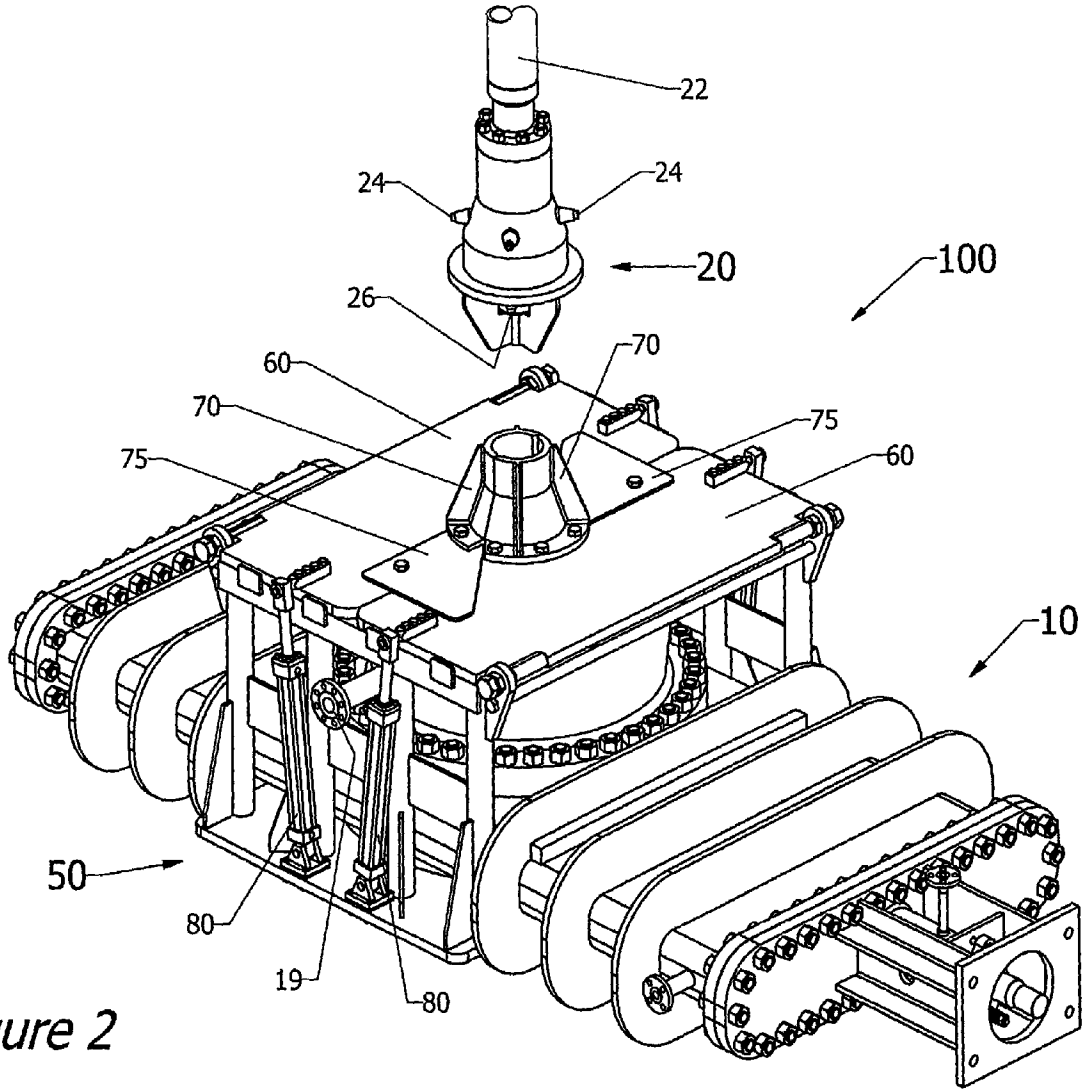
FIG. 2 is a perspective view of one embodiment of a drill stem guide and cover system in conjunction with the gate valve of FIG. 1, with covers shown in the closed position and a drill stem with cutting tool positioned above.

A drill stem guide assembly 100 according to one embodiment illustrated in FIG. 2 is mounted on the top head of a coke drum and comprises the following major components:

Mounting Frame 50,
Cover or Covers 60,
Guide Sections 70, and
Cover Actuators 80.

Figure 12:
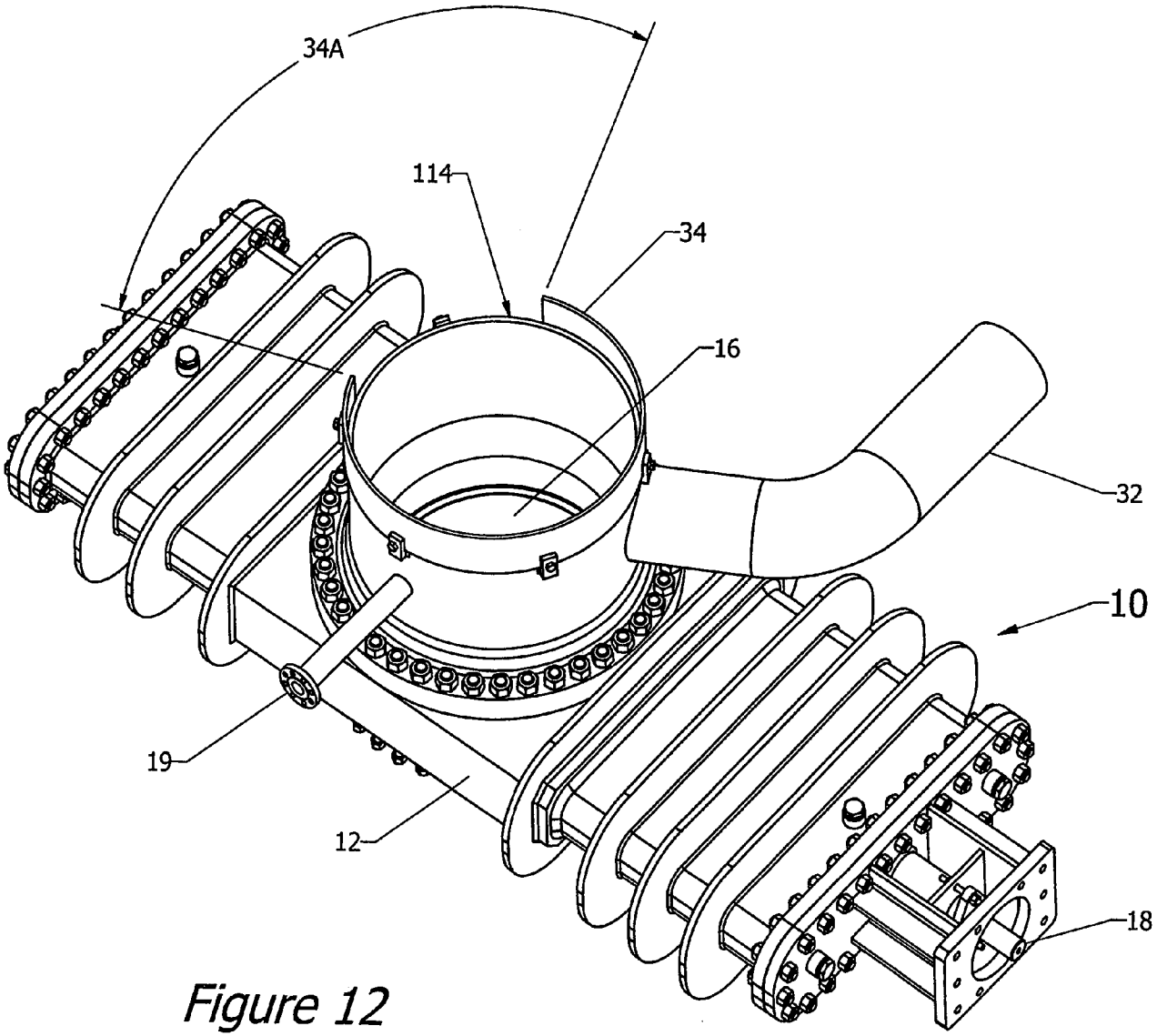
FIG. 12 is a perspective view of another embodiment of a gate valve as used for coke drum top unheading service, with a top spool element, a spool shroud, a snuffing steam connection, and a vent pipe.

Top Unheading Valve: The embodiments shown in FIGS. 2 through 8 and 13 are typically used with a 36"-300# (or sized as required to match the drum's top nozzle) top unheading thru-conduit gate valve such as the gate valve 10 of FIG. 1 with a top spool 14 rather than a manually bolted and flanged head for the safety and production efficiency purposes mentioned above. As shown in FIGS. 1 and 12, the valve 10, comprises a main valve body 12, a top spool (in FIG. 2, 14 and in FIG. 12, 114), a gate or disc 16 and a valve stem or shaft 18.

Figure 9:
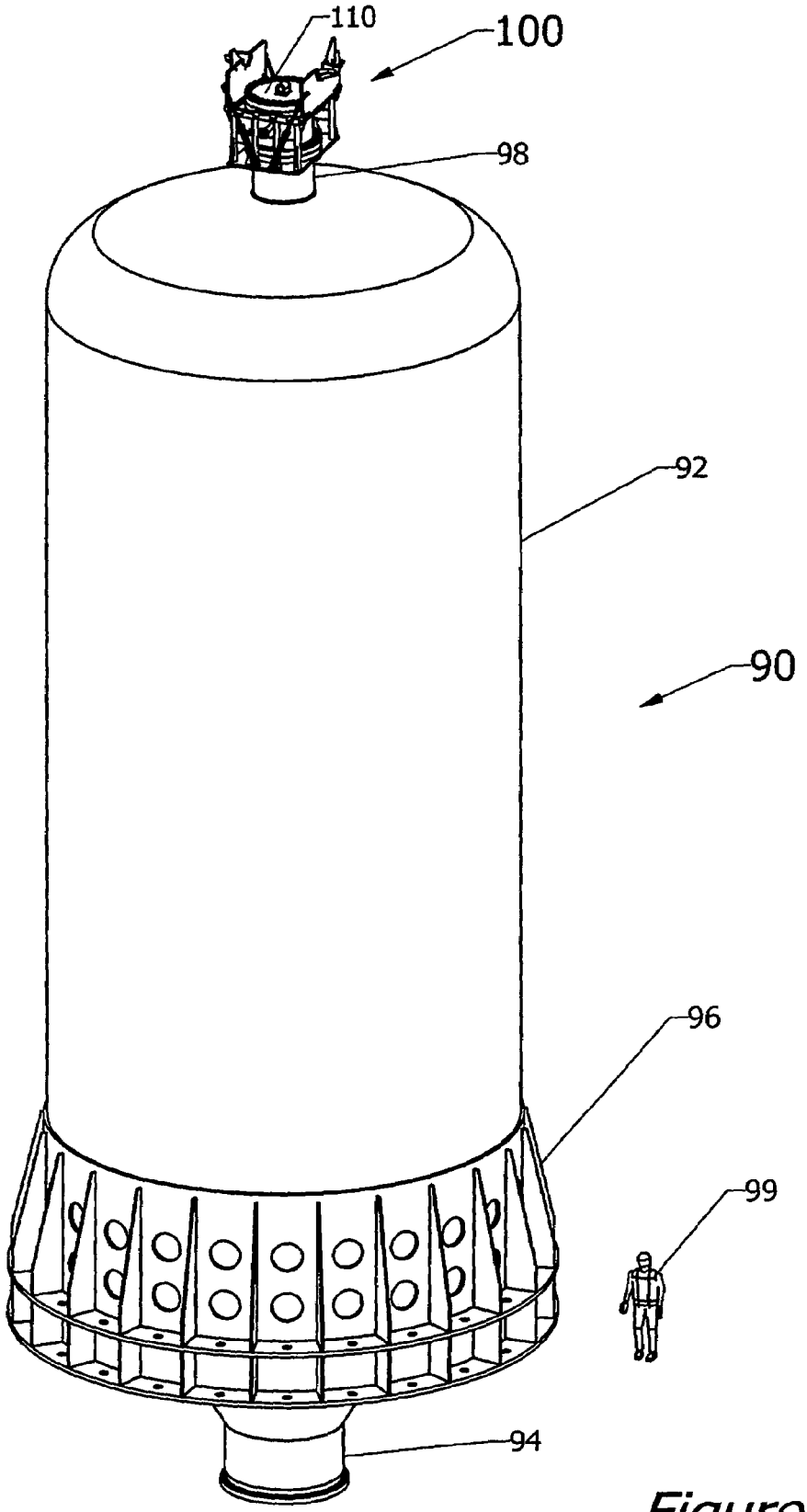
FIG. 9 is a perspective view illustrating another embodiment, as configured with a manually bolted blind flange and mounted on the top head of a coke drum.
Figure 10:
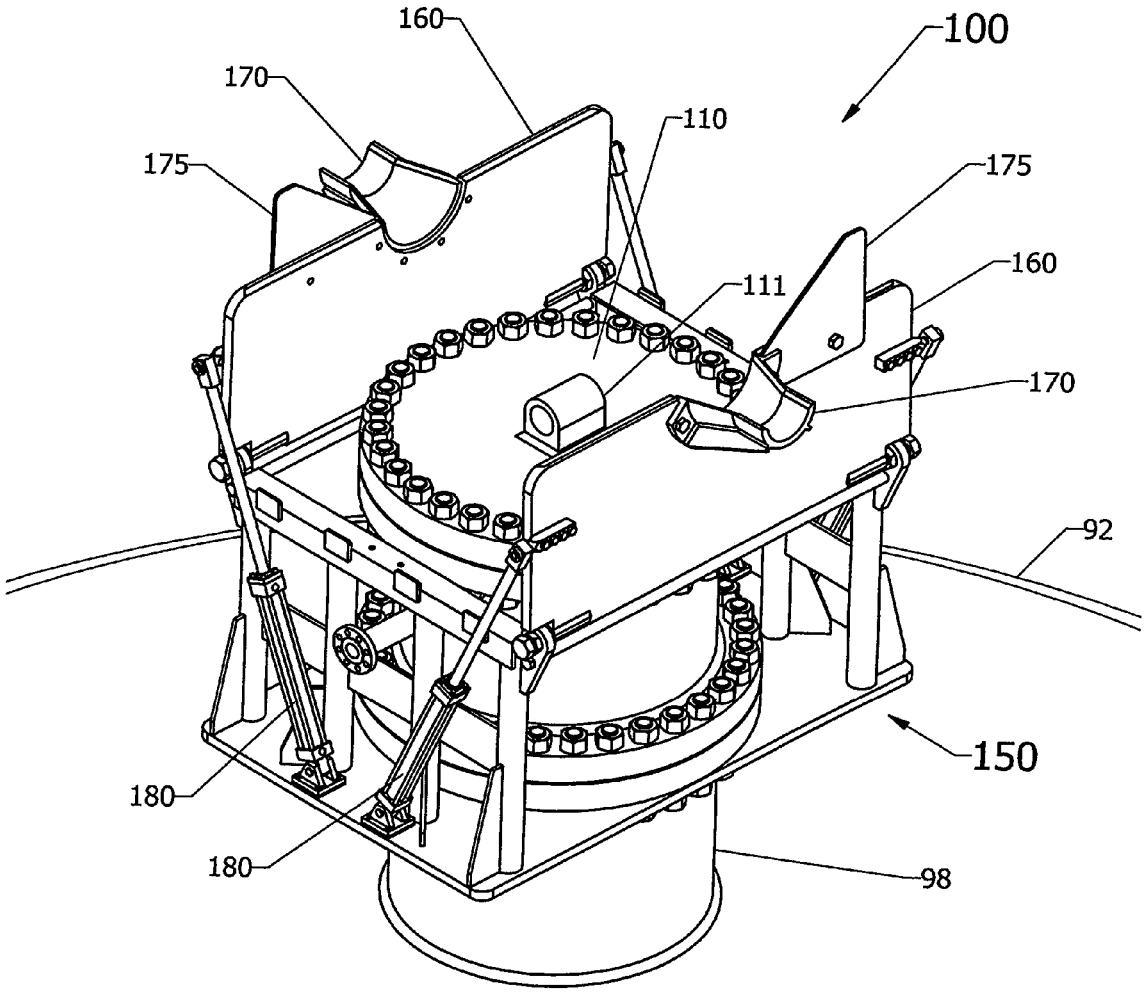
FIG. 10 is a close-up perspective view of the embodiment of FIG. 9.

In the embodiment of FIG. 12, mounted onto the top spool 114 is a vent pipe 32, spool shroud 34 and snuffing steam connection 19. Vent pipe 32 is open to the interior of top spool 114 and positioned to direct hot steam flow from top spool 114 to a safe location away from DCU operators and equipment. Similarly spool shroud 34 partially surrounds the top of spool 114 to affect an opening 34A. Shroud 34 and opening direction 34A are positioned to direct hot steam from top spool 114 toward a safe location away from DCU operators and equipment. Vent pipe 32 and spool shroud 34 may be utilized in any combination, independently or not at all. Actual usage is determined by overall DCU plant philosophy, process and operating parameters. While a top unheading valve is not a requirement of the drill stem guide and cover system, it is certainly recommended to provide increased safety and efficient production operation. Embodiments of the drill stem guide assembly disclosed herein can also be used in conjunction with manually bolted heads and flanges (i.e. without a top unheading valve 10) as shown in FIGS. 9 and 10.

Mounting Frame: One portion of the drill stem guide assembly 100 according to some embodiments is a mounting frame or base 50, typically constructed of welded steel, as shown in FIG. 2, that provides convenient mounting locations for covers 60, guide sections 70 and actuator system 80. The mounting frame 50 may be connected directly to the top head 98 of coke drum 90 as shown in FIG. 9 and 10 or may be mounted independently on other structural or platform steelwork at the top head location. Although typically connected by bolting the mounting frame 50 to the mounting location, other connection techniques can be used. Attaching the mounting frame 50 directly to the drum top head 98 has the advantage of transferring the coke drum 90's upward thermal expansion (typically 100 to 250 mm [4" to 10"]) to the drill stem guide assembly 100, since the two will move together. For independent mounting, thermal expansion must be accommodated by providing clearance or moving components elsewhere. Providing this amount of clearance can compromise the desired close fitting cover, and additional moving parts often add unneeded complexity.

In the embodiments of FIGS. 2 through 8, mounting frame 50 is conveniently attached directly to the top head 98 but also directly underneath the top unheading gate valve 10. This configuration insures that loads and forces produced by the drill stem 22 in the guide sections 70 are not transferred to the valve 10 but rather through the mounting frame 50 and to the more robust top head 98 of the coke drum 90.

Covers: Covers 60 serve several functions in these embodiments. As illustrated in FIGS. 2 through 8 and 13, the covers 60 are used to securely mount the guide sections 70 that centralize the drill stem 22 during coke cutting operations. The covers 60 are hinged and equipped with hydraulic cylinder and piston actuators 80 to open and close the covers and allow the larger cutting tool 20 to travel past the loose fitting guide sections 70. Although described here as hydraulic pistons and cylinders, other types of actuators could be used such as pneumatic actuators or electromechanical gear operators. The covers 60 are also easily opened and closed to withdraw and access the cutting tool 20 allowing an operator to mechanically switch cutting water flow to the cutting tool 20's nozzles from downward pointing nozzles 26 to outward facing nozzles 24. The covers 60 shown in FIGS. 2 through 8 are illustrative and exemplary only, and other cover configurations or numbers of covers can be used as desired. For example, in one embodiment, only one of the covers is openable.

Figure 7:
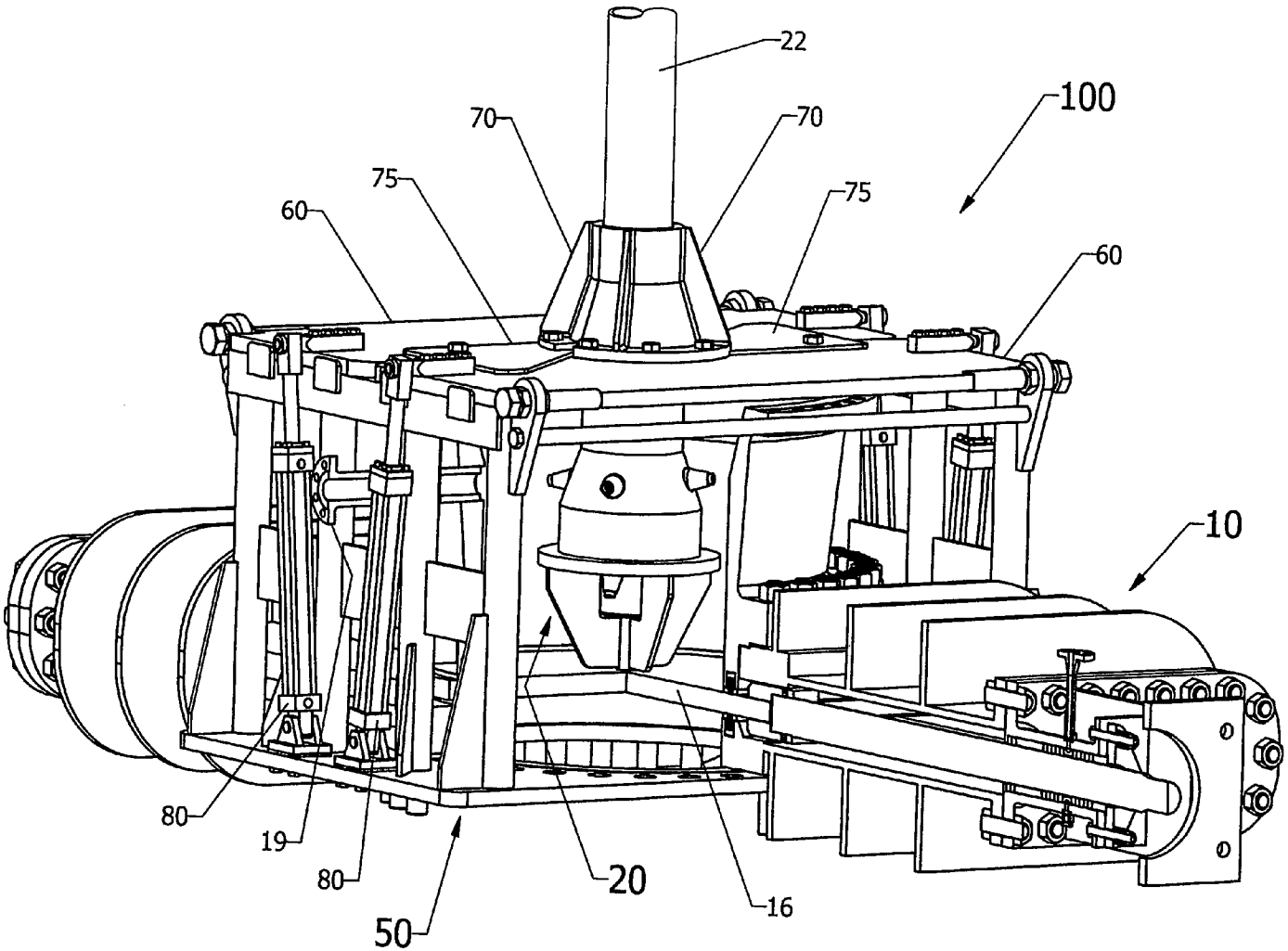
FIG. 7 is a cutaway view of the embodiment of FIG. 2 with the drill stem fully captured by the drill stem guide formed by the closed covers and the cutting tool positioned below the closed covers but above the valve gate.

Auto-shifting cutting heads, a new development in coke cutting technology offered by the Flowserve Corporation, are not switched manually by an operator turning a lever on the cutting head. Auto-shifting cutting heads use a valve mechanism inside the cutting tool 20 to switch the cutting water flow to the other nozzles every time the cutting water pressure is turned off and back on, therefore, they do not require opening the covers 60 to withdraw the cutting tool 20 and the cutting tool 20 may be parked underneath the covers 60 but above the valve gate 16 as shown in FIG. 7. In this embodiment, the usually closed covers 60 also prevent debris from falling or accumulating on the valve gate 16.

During cutting operations, unexpected hot spots may be encountered in the coke formation. These hot spots can rapidly vaporize cutting water to produce and release a large amount of steam, hot water and coke particles out the top head 98, also known as steam eruptions or steam geysers. If the drum top head 98 is uncovered, a large sudden steam release can produce a dangerous environment that is hazardous to DCU personnel working on the cutting deck or in the immediate area. The drill stem guide and cover system covers 60 are held down by the actuators 80 to contain such sudden and dangerous steam releases until the excess steam pressure is relieved gradually. If the drill stem guide and cover system 100 is so equipped, the steam eruption may also be discharged to a safe location by vent pipe 32 or in a safe direction with the drill stem guide and cover system top shroud 34 feature shown in FIG. 12.

A more dangerous scenario during coke cutting is drilling into a trapped pocket of flammable hydrocarbon vapor than can be more lethal than steam or cause a massive and destructive fire. In this case the closed covers 60 contain the vapor release to prevent a free burning condition and also permit snuffing steam to be introduced via a snuffing steam connection 19, illustrated in FIGS. 2 and 12, into top spool 14 or 114 and thereby into the top of the coke drum 90. Snuffing steam supplied there is used to blanket the fire and prevent air containing oxygen from reaching the fire or, conversely, vapors from the drum reaching the air. Without the covers 60 and a snuffing steam connection 19, such a vapor release and/or fire is largely uncontrolled and may present an enormous safety hazard.

Drill Stem Guide: The drill stem 22 is typically positioned and maintained in the center of the coke drum 90 during pilot hole drilling and drum cutting to break up coke efficiently and completely, prevent cave-ins and empty the coke drum 90 uniformly. Many conventional cutting operations use drill stem guides located high above the top head (not shown in the Figures) and then rely on gravity and the weight of the drill stem 22 to centralize the stem 22 in the opening of the top head 98. Centering the drill stem 22 is not generally a problem, but an unguided cutting tool 20 can walk or move while drilling. The long and spindly drill stem 22 often bends while in service. The difficulty in accurately positioning and keeping the drill stem 22 in the center of the coke drum 90 is reduced with the guide sections 70. In addition, even a moderate wind at the cutting deck level (usually located at least 30 m [100 ft] above grade), can cause the long drill stem 22 to sway and become difficult to place and maintain in the center of the top head 98.

The guide sections 70 both capture and loosely hold the drill stem 22 in the center of the top head 98. The drill stem guide 70 formed by sections on each cover 60 is designed for a loose fit around the drill stem 22, allowing it to rotate freely while still guiding its position. By design, the drill stem guide 70 is removable and made from material softer than the drill stem 22, such as bronze, so that it can be easily and economically replaced after it wears out. Alternatively, the guide sections can be configured such that a portion of the guide section is a separate, removable wear section. In FIG. 2, the guide sections 70 are shown attached to the covers 60 by bolts, but this depiction is illustrative and exemplary only, and other methods of attaching the guide sections 70 to the covers 60 can be used as desired. The guide sections 70 are attached to the covers 60 such that when the covers 60 are fully closed, the guide sections 70 collectively form a single passageway for the travel of the drill stem 22.

FIGS. 2 through 8 show a basic drill stem capture system whereby simply closing the two-piece covers 60 with the stem 22 lowered to the appropriate position, positions the drill stem guide 70 loosely around drill stem 22 to guide and hold it in place. There are also numerous other grappling/capture mechanisms commonly found in industry that can be used for the same purpose. The guide sections 70 shown in FIGS. 2 through 8 are illustrative and exemplary only, and other configurations of guide sections can be used as desired. For example, four-piece hinged covers may be employed and additional spring or mechanically actuated grappling "fingers" can be attached to the covers 60 to enable the drill stem guide and cover system 100 to better suit other stem and top head 98 configurations.

FIG. 2 illustrates the drill stem guide and cover system 100 with the covers 60 in the closed position prior to insertion of the cutting tool 20 on the drill stem 22. The guide sections 70 form the passageway for the drill stem 22 when the covers 60 are in the closed position. The guide sections 70 shown in FIG. 2 are illustrative and exemplary only, and other guide section shapes can be used as desired. For example, although FIG. 2 shows an embodiment with guide sections 70, in other embodiments polygonal guide sections 70 can be used. Optional shields 75 can be attached to the covers 60 to reduce the danger of the release of hot or explosive gases through the seam formed by the closed covers 60. The shields 75 shown in FIG. 2 are illustrative and exemplary only, and other configurations or numbers of shields 75 can be used as desired. For example, although FIG. 2 shows an embodiment with a pair of shields 75, in other embodiments, a singular shield 75 attached to only one of the covers 60 can be used. Alternatively, the shields 75 can be configured to aid in capturing the drill stem 22 as the covers 60 close. The actuators 80 attached to the mounting frame 50 open the covers 60 on command from an operator (not shown). Once the covers 60 are opened, the cutting tool 20 can be lowered on the drill stem 22 so that the cutting tool 20 can pass through the gate valve 10 when the gate valve 10 is in the open position. The cutting tool 20 is typically comprised of downward facing nozzles 26 for cutting a hole for the drill stem to travel through the coke and sideways facing nozzles 24 for cutting the coke into small pieces.

Figure 3:
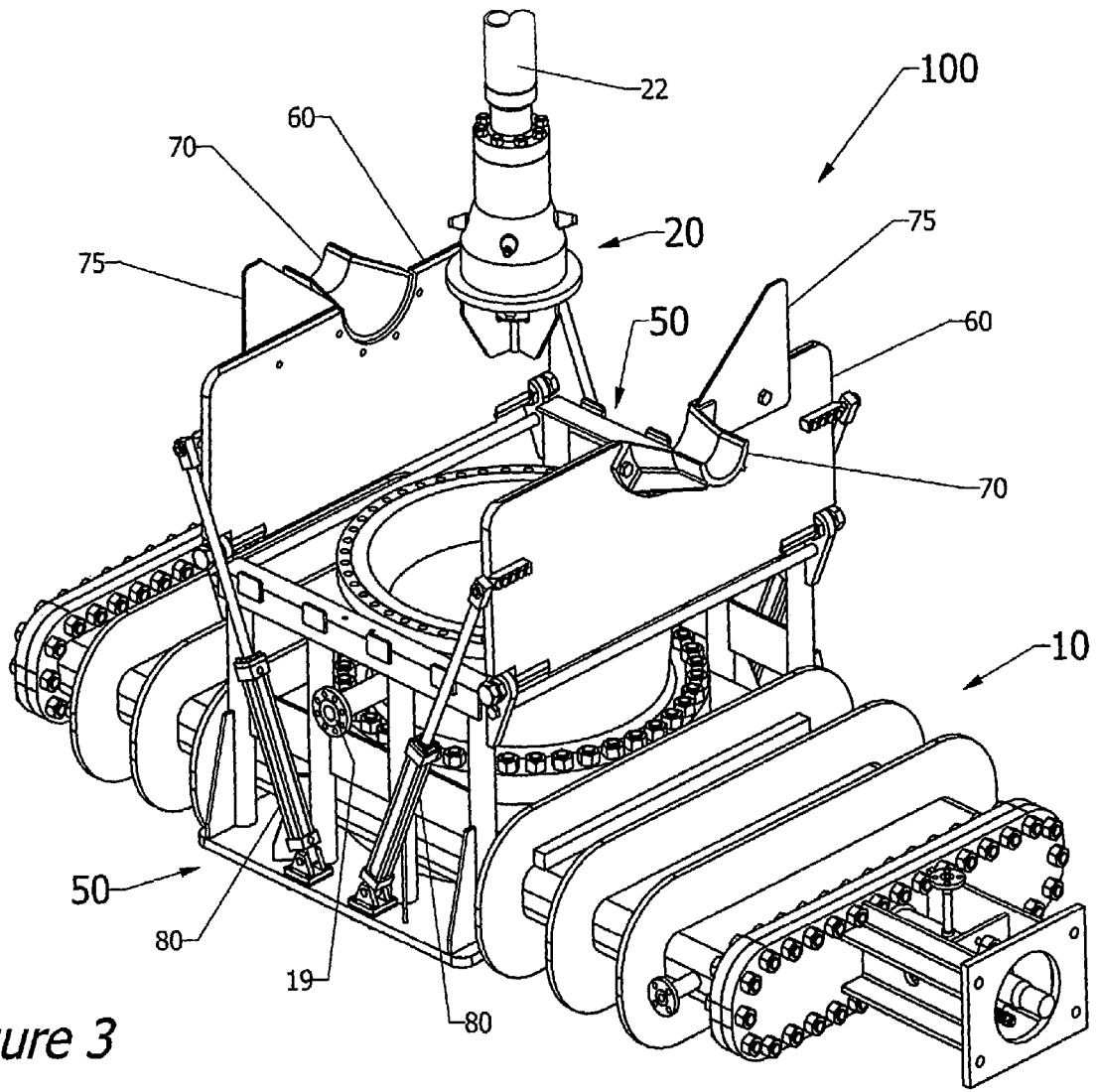
FIG. 3 is a perspective view that illustrates the embodiment of FIG. 2 with the covers open.
Figure 4:
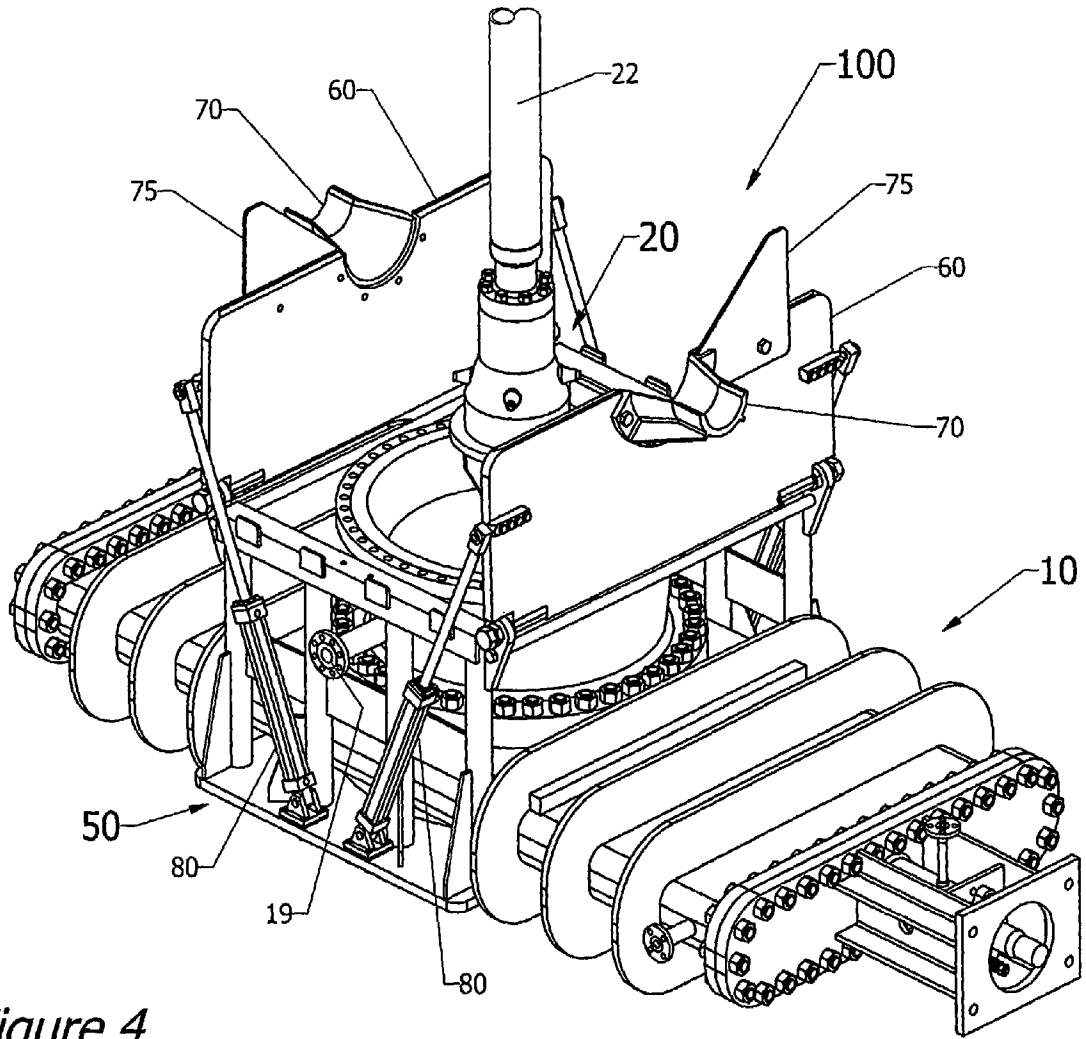
FIG. 4 is a perspective view of the embodiment of FIG. 2 with the covers open and the drill stem with cutting tool being lowered.

FIG. 3 illustrates the drill stem guide and cover system 100 after the actuators 80 have moved the covers 60 into the open position with the cutting tool 20 directly above the valve gate 16 (not shown). FIG. 4 depicts the cutting tool 20 being lowered on the drill stem 22 into the opening formed by the open covers 60.

Figure 5:
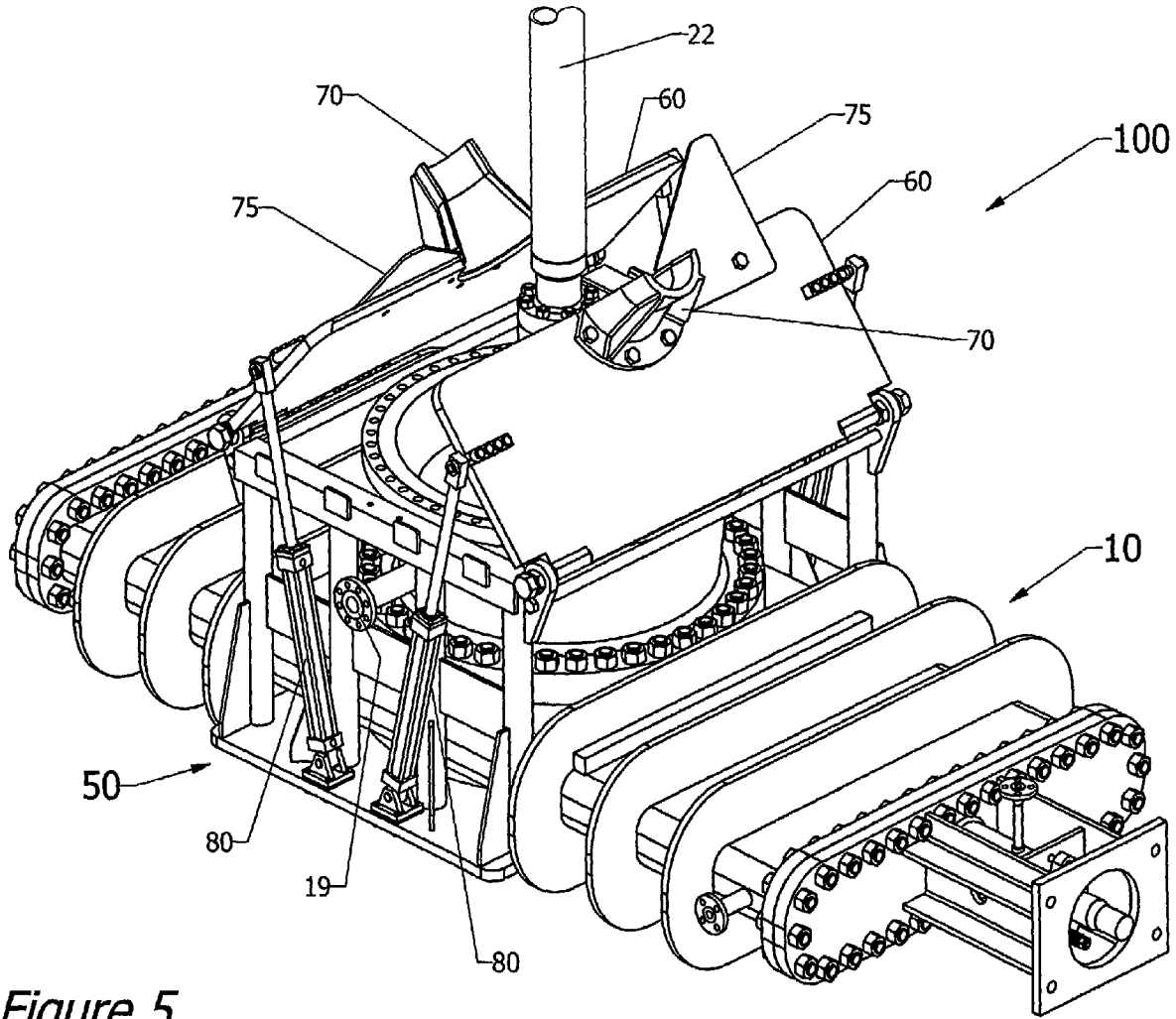
FIG. 5 is a perspective view of the embodiment of FIG. 2 as the covers are being closed.
Figure 6:
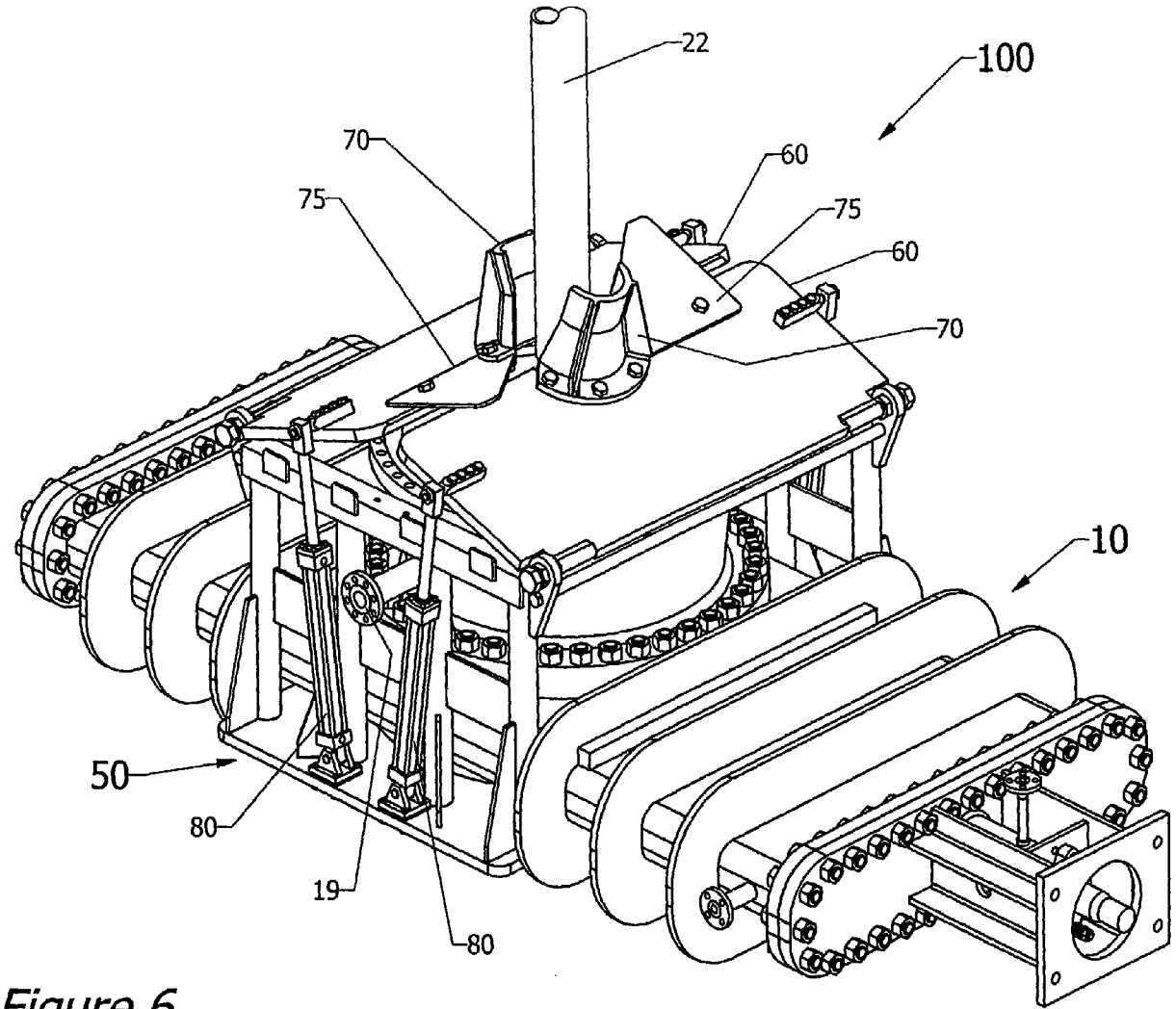
FIG. 6 is a perspective view of the embodiment of FIG. 2 as the covers are almost fully closed and capturing the drill stem that is lowered down into the top spool of the valve.

FIG. 5 illustrates the covers 60 in transition between the open and closed positions as the actuators 80 move the covers 60 to the closed position. The drill stem 22 is positioned such that the guide sections 70 will close with the drill stem 22 near the center of the passageway formed by guide sections 70 when the covers 60 are fully closed. The cutting tool 20 is below the top of the mounting frame 50, and it can be seen that the passageway formed by the guide sections 70 will be narrower than the cutting tool 20. FIG. 6 depicts the covers 60 in an almost fully closed position with the guide sections 70 capturing the cutting tool 20 (not shown in FIG. 6).

FIG. 7 is a cutaway view that illustrates the position of the cutting tool 20 on the drill stem 22 after the covers 60 have been fully closed by the actuators 80. The cutting tool is parked above the valve gate 16. The mounting frame 50 is typically sized so that the cutting tool 20 may remain parked without interfering with the opening or closing of the gate valve 10.

Figure 8:
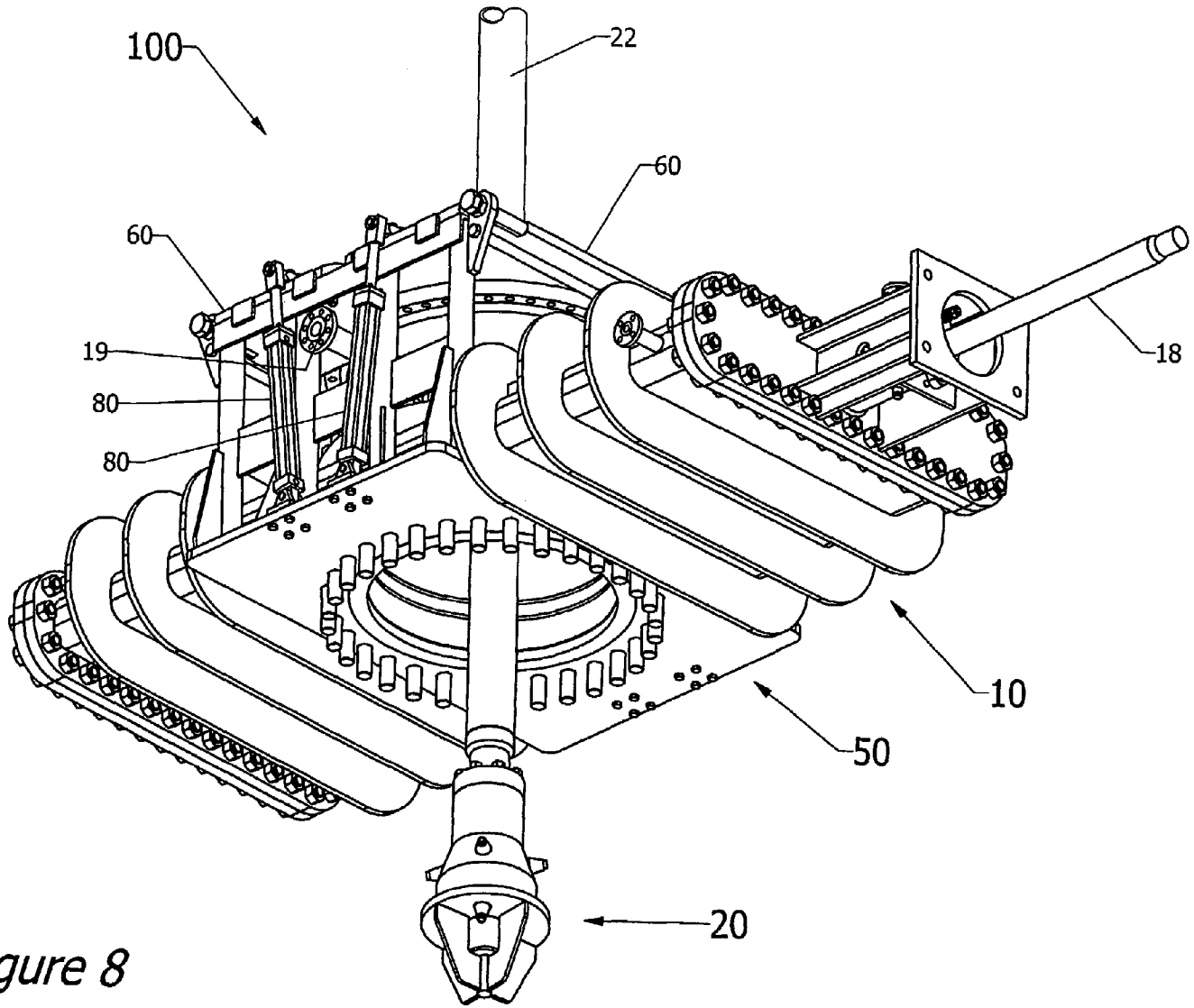
FIG. 8 is a perspective view of the embodiment of FIG. 2 from beneath the gate valve with the drill stem and cutting tool lowered through the valve gate.

FIG. 8 illustrates the passage of the cutting tool 20 on the drill stem 22 through the gate valve 10 when gate valve 10 is in the open position. The covers 60 are closed, and the drill stem 22 may be lowered or raised without interference from the closed covers 60 since the drill stem 22 is traveling through the passageway formed by the guide sections 70 (not shown in FIG. 8).

Figure 13:
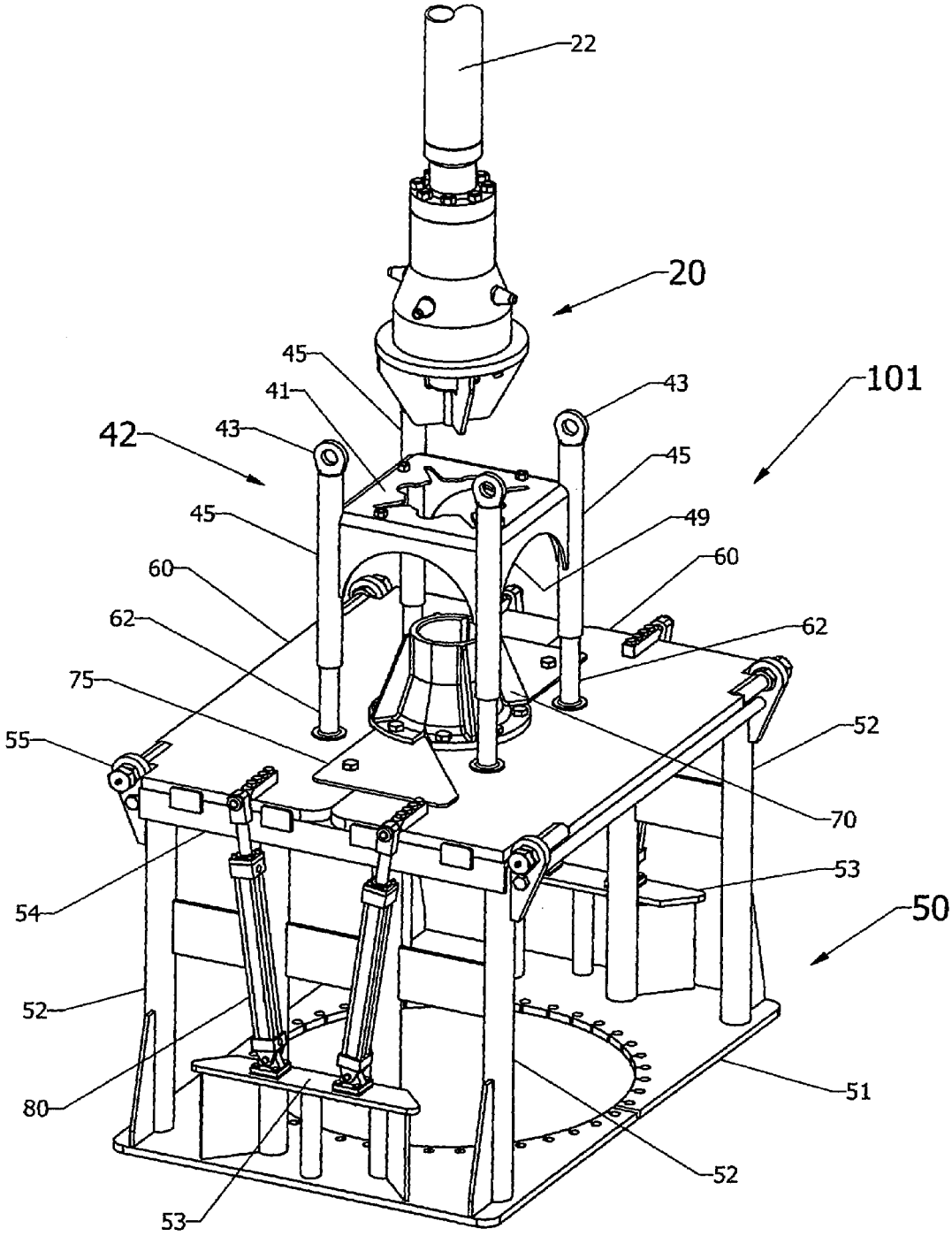
FIG. 13 is a perspective view of another embodiment, including a cutting tool maintenance cradle and a cutting tool being lowered into the maintenance cradle.

FIG. 13 illustrates one embodiment of the drill stem guide and cover system 101 standing alone. In the embodiment illustrated in FIG. 13, the mounting frame 50 is made up of a frame base 51, frame supports 52, actuator supports 53, frame top 54, and attachment points 55. The frame base 51 attaches with the top head of the coke drum 90 (not shown in FIG. 13). While the frame base 51 is shown as split in FIG. 13, this depiction is illustrative and exemplary only, and other configurations of frame base 51 may be used as desired. For example, although FIG. 13 shows an embodiment with a split plate, in other embodiments, the frame base 51 may be a single piece. The frame supports 52 attach to the frame base 51 so as to attach the frame top 54 to the frame base 51. Although FIG. 13 shows four frame supports 52, this depiction is illustrative and exemplary only, and other numbers, configurations, and positions of frame supports 52 may be used to attach the frame top 54 to the frame base 51. The actuators 80 are connected to the covers 60 and the actuator supports 53. The actuator supports 53 in FIG. 13 are illustrative and exemplary only, and other configurations of actuator supports 53 may be used as desired. For example, the actuator supports 53 may be wider or higher. In one embodiment, as shown in FIG. 2, no actuator supports are used. The frame top 54 serves as an mounting place for the attachment points 55 and a closed position resting place for the covers 60. The frame top 54 shown in FIG. 13 is illustrative and exemplary only, and other frame top configurations can be used as desired.

FIG. 13 illustrates an additional feature of one embodiment of the drill stem guide and cover system 101, a cutting tool maintenance cradle 42. The maintenance cradle 42 is typically not permanently attached to the covers 60 but is a separate fixture that is used when necessary for maintenance or other purposes. Periodically the cutting tool 20 must be disconnected from the drill stem 22 and removed for maintenance. A typical commercial cutting tool 20 weighs approximately 180 kg [400 lbs] and is also difficult to handle due to its awkward shape. To facilitate this operation, the cutting tool 20 can be lowered and safely secured in the maintenance cradle 42, which has a maintenance base 41 dimensioned to hold and support the cutting tool 20. While depicted with a cutout for a specific cutting tool 20, the maintenance base 41 in FIG. 13 is illustrative and exemplary only, and other cutouts can be used as desired. Additionally, the existing placement of the maintenance base 41 in FIG. 13 is illustrative and exemplary only, and the maintenance base 41 can be rotated into other positions as desired. Initially cradle guide pins 62 are inserted into the covers 60 to properly locate, guide and stabilize the cradle 42. Tubular members 45 of the maintenance cradle 42 fit loosely over the guide pins 62 and may also be fitted with springs (such as the spring 47 of FIG. 14) in order to absorb and cushion the downward motion of the cutting tool 20 as it is lowered into the cradle 42. Once securely held in the cradle 42 and disconnected from the drill stem 22, the cradle 42 with cutting tool 20 can be lifted free from the guide pins 62 using lift lugs 43 and other conventional lifting apparatus. The cutting tool maintenance cradle 42 is used equally well with the top unheading valve 10 or the manual unheading system shown in FIGS. 9 and 10. Although, as illustrated in FIG. 13, the maintenance cradle 42 uses lift lugs 43 for lifting other lifting mechanisms can be used.

Figure 14:
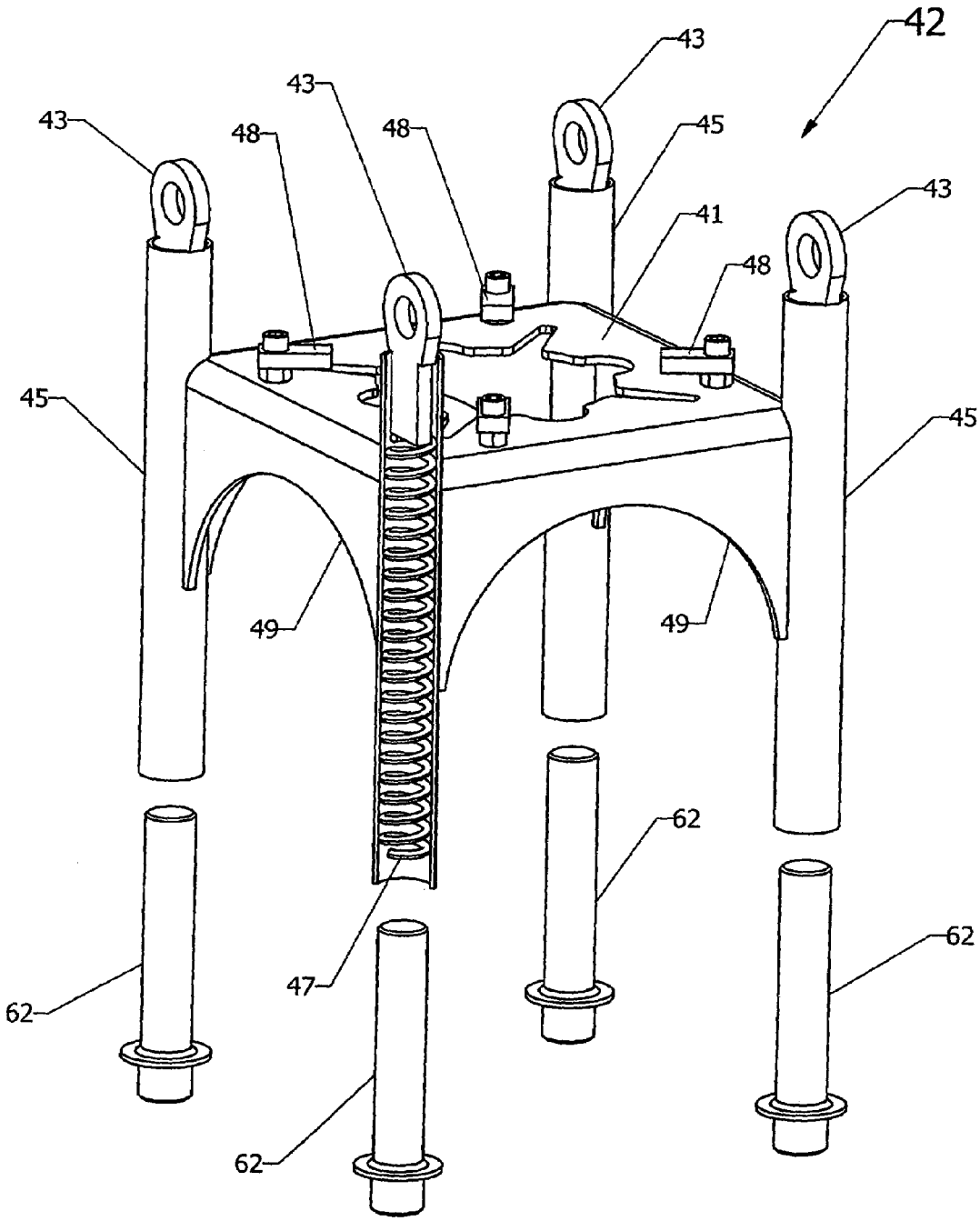
FIG. 14 is a cutaway view of the cutting tool maintenance cradle of FIG. 13.

FIG. 14 illustrates an embodiment of the maintenance cradle 42, which is comprised of tubular members 45, tubular member supports 49, springs 47, the maintenance base 41, and lift lugs 43. The maintenance base 41 is dimensioned to hold the cutting tool 20 (not shown in FIG. 14). Hold down bars 48 can be attached to the maintenance base 41. When the cutting tool 20 (not shown in FIG. 14) is fully lowered onto the maintenance cradle 42, the hold down bars 48 can be used to secure the cutting tool 20 (not shown in FIG. 14) to the maintenance base 41. The tubular members 45 are designed to fit over guide pins 62 that can be attached to the covers 60. The tubular members 45 in FIG. 14 are illustrative and exemplary only, and other type of tubular members can be used as desired. In addition, other techniques for disposing the maintenance cradle on the covers 60 can be used. For example, while FIG. 14 shows an embodiment with tubular members 45 that are cylindrical and hollow for their entire length, in other embodiments, rectangular designs or designs that are only partially hollow can be used. Springs 47 can be inserted into the tubular members 45 so as to absorb shock or cushion the maintenance cradle 42 when the cutting tool 20 (not shown in FIG. 14) is lowered onto the maintenance base 41. Although illustrated in FIG. 14 with a single spring 47 in one of the tubular members 45, typically each tubular member 45 contains spring 47. The springs 47 in FIG. 14 are illustrative and exemplary only, and other shock absorbing materials or devices can be used as desired. For example, although FIG. 14 shows an embodiment with a mechanical spring, in other embodiments, a gas-charged shock absorber can be used. The tubular members 45 are braced by tubular member supports 49. While the supports 49 are depicted as an arch shaped design in FIG. 14, the tubular member supports 49 in FIG. 14 are illustrative and exemplary only, and other shaped supports can be used as desired. For example, in another embodiment, a rectangular tubular member support could be used to support the tubular members 45.

Configuration for Manual Top Unheading: As stated above, the drill stem guide and cover system 100 may include a top unheading valve 10 or be used in conjunction with a manually bolted top head flange 110 as best shown in FIG. 10. Both embodiments are mechanically and functionally similar and provide similar safety and production benefits. The controls for the manual top unheading drill stem guide and cover system will naturally not include interconnections to a top unheading valve 10 and therefore are typically less complex. FIG. 9 shows a typical manual top unheading drill stem guide and cover system 100 mounted on top of a coke drum 90. The coke drum 90 includes a drum proper 92, bottom discharge nozzle or bottom head 94, drum mounting skirt 96 and top nozzle or top head 98. To convey approximate size, FIG. 9 also depicts a coker operator 99 in proximity to coke drum 90. Other elements may be present as desired.

FIG. 10 shows additional detail of an embodiment of the drill stem guide assembly 100 in a manual top unheading configuration comprising the same major components as shown in FIGS. 2 through 8: mounting frame 150, covers 160, guide sections 170 and cover actuators 180. The optional shields 175 are also included in the embodiment depicted in FIG. 10. These components are configured similarly and correspond to the mounting frame 50, covers 60, guide sections 70, cover actuators 80 and shields 75 illustrated in FIGS. 2 through 8. Notably absent from FIG. 10 is the top unheading valve 10, which is replaced in this embodiment by a manually bolted top blind flange 110 to close off and seal the coke drum 90 during the coking process. The top blind flange 110 may be unbolted and lifted off via a flange lifting lug 111. Once the top blind flange 110 is removed to allow entry into the top head 98, the drill stem 22 (not shown) and cutting tool 20 (not shown) may be lowered into the top head 98. Once the cutting tool 20 (not shown in FIG. 10) has descended below the top of the mounting frame 150, the actuators 180 can move the covers 160 into the closed position. The guide sections 170 then form a loose fitting passageway that will capture the cutting tool 20 but allow free travel of the drill stem 22 (not shown in FIG. 10). When the covers 160 are in the closed position, the shields 175 overlap the seam formed by the covers 160 to prevent the explosive release of hot or explosive gases.

Figure 11:
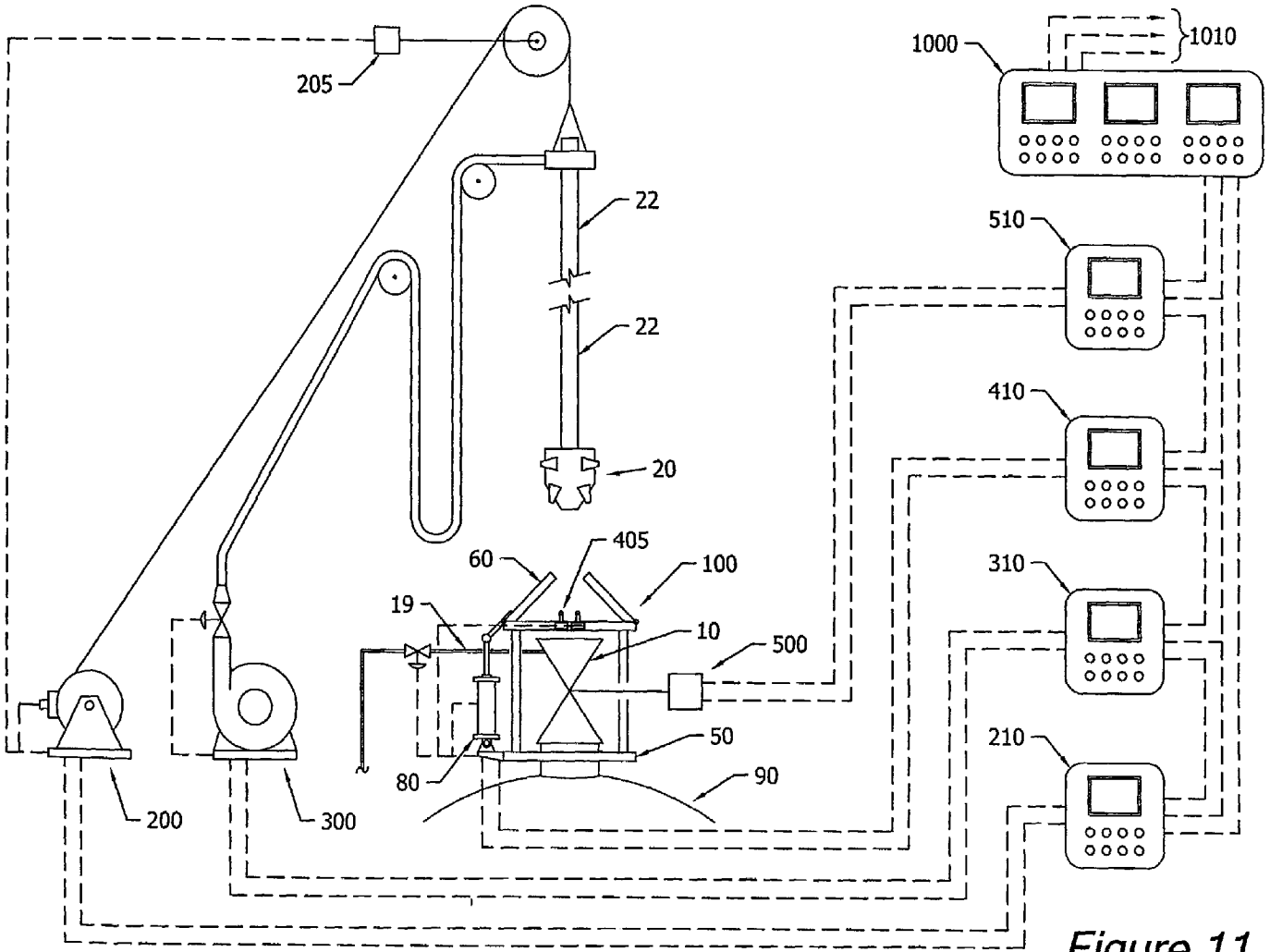
FIG. 11 is an elevation view and schematic diagram illustrating an embodiment as used with a top unheading valve in a DCU top unheading system.

Cover Actuators and Control System: Actuators, limit switches, piping, and valves with the interconnecting electric, electronic and pressure controls can be used to operate the drill stem guide and cover system in conjunction with the existing DCU logic and controls. The actuators 80 and 180 are shown for illustration in FIGS. 2 through 10 and 13 while other specific control components are straightforward, common industrial items and have been omitted for clarity in those Figures. FIG. 11 is a basic schematic showing an elevation view of typical top unheading devices with their respective control systems:

- Winch Motor 200 for raising and lowering the cutting tool 20 with control system 210,
- High-Pressure Cutting Water Pump 300 with control system 310,
- Drill Stem Guide and Cover System 100, as illustrated in detail in FIGS. 2 through 8, including cover actuators 80 (hydraulic cylinder assemblies shown in alternate position in FIG. 10) with a control system 410,
- Top Unheading Valve 10, valve actuator 500 with control system 510, and
- Local Top Unheading Control System 1000 with interconnection 1010 to an Overall DCU Plant Control System (not shown), which can be any conventional plant control system.

Each actuator 80 and control system 410 is typically individually reviewed and customized as needed for the available air, water, steam, electrical, etc. utilities and to properly interact with any DCU function permission protocol and safety interlocks.

A primary function of the control system 410 is to open and close the covers 60 at the appropriate times during coke drum unheading, pilot drilling and cutting operations. The control system 410 shown in FIG. 11 is illustrative and exemplary only, and other control configurations can be used as desired. For example, while FIG. 11 shows an embodiment with an electrical connection between the control system 410 and the DCU control system 1000 and between the control system 410 and the actuators 80, in other embodiments, radio communication can be used between the control system 410 and the actuators 80 and between the control system 410 and the DCU control system 1000. Under normal conditions the covers 60 remain closed and, if possible, closed around the drill stem 22 with the cutting tool 20 parked underneath but above the valve gate 16. This covers and protects the valve gate 16 as described above. A safety interlock device such as a drill stem travel limit switch 205 can be set to signal the winch motor 200 not to lower the drill stem 22 and cutting tool 20 beyond a point set in the drill stem travel limit switch 205 until the unheading gate valve 10 is fully opened.

FIG. 11 illustrates the control system of the drill stem guide and cover system 100. When the covers 60 are not in the closed position, a limit switch 405 is activated. The limit switch 405 alerts the drill stem guide control system 410 that the covers 60 are not in the closed position. The control system 410 and limit switches 405 depicted in FIG. 11 are illustrative and exemplary only, other conventional control systems and switches can be used as desired. Control system 410 is in communication with the Local Top Unheading control system 1000, the valve actuator control system 510 and the high pressure water supply controller 310. Control system 410 can signal the high pressure cutting water controller 310, which will instruct the high pressure cutting water pump 300 to deactivate. This prevents high pressure water from flowing from the high pressure water supply 300 to the cutting tool 20 when the covers 60 are not in the closed position. Control system 410, upon receiving a command from an operator or from Local Top Unheading control system 1000, can signal the actuators 80 to move the covers 60 to the open position or to the closed position. The valve actuator control system 510 can signal the valve actuator 500 to open gate valve 10. If the gate valve 10 is not fully open, the valve actuator control system 510 sends a signal to the winch motor control system 210. If the winch motor 200 is lowering the drill stem 22 past a preset distance when the gate valve 10 is not fully open, drill stem travel limit switch 205 will alert the winch motor control system 210, which will prevent the winch motor 200 from continuing to lower the drill stem 22.

After coking and cooling the coke drum 90, excess cooling steam is often released by partially or fully opening the top unheading valve 10 using the control system 510 and valve actuator 500. The closed covers 60 fit closely but not tightly over the top spool 14, allowing steam to escape to the atmosphere through small gaps, via a vent pipe 32, top shroud opening 34A or any suitable combination thereof in a safe and controlled manner. The covers 60 can also be opened and adjusted with the actuator 80 and control system 410 for greater or the desired steam release.

In some embodiments, actuators 80 and control system 410 include interlock devices and logic that shut off the high pressure cutting water if the cutting tool 20 is inadvertently raised above the top spool 14. The extremely high pressure water jets striking equipment and personnel can cause serious damage and injuries. Electronic limit switches 405 in the mounting frame 50 and connected to the control system 410 can sense the covers 60 in the closed position. If the cutting tool 20 is raised and begins to lift the covers 60, the limit switches 405 alert the control system 410, which in turn commands control system 310 to immediately turn off the high pressure cutting water supply, preventing the dangerous condition and initiating an alarm.

The actuators 80 and control system 410 can be operated manually by operator pushbutton or other suitable controls (not shown) at control system 410 as well as interconnected to the DCU plant or other control system 1000 for fully automated operation. The plant's overall operating philosophy, history, experience, operator training and specific safety concerns typically determine the level of automation and safety interlocks required, provided and implemented with the drill stem guide and cover system.

The accompanying figures, descriptions and explanation of features and construction illustrate the basic principle of this new system. However, specific sizes, exact details and materials of construction are selected to suit particular requirements of each coke drum and DCU service application.

For example, the size and rating of the coke drum top connection typically determine the size of the unheading valve and cover system. Similarly the size and type of drill stem and drilling tip typically dictate the majority of drill stem guiding details and arrangement.

The foregoing disclosure and description of the invention are illustrative and explanatory thereof, and various changes in the details of the illustrated apparatus and construction and the method of operation may be made without departing from the spirit of the invention.

What is claimed is:

1. A drill stem guide assembly for insertion of a drill stem into a coke drum for coke cutting operations, comprising:

a plurality of covers moveable between an open position and a folded closed position, each of the plurality of covers comprising:

a guide section elongate to extend along a segment of the drill stem when the covers are in the folded closed position;

a mounting frame configured to pivotally attach the plurality of covers, the covers being pivotally attached to the mounting frame with each cover pivoting between the open and folded closed positions, the pivoting being about pivot axes that are transverse to the elongation of the guide section and the drill stem when the covers are in the folded closed position; and a plurality of actuators disposed on the mounting frame to move the plurality of covers between the open position and the folded closed position, wherein, when the plurality of covers is in the folded closed position, the guide sections of the plurality of covers form a passageway for guiding the drill stem as the drill stem is moved within the coke drum.

2. The drill stem guide assembly of claim 1, wherein the guide section is made of a material softer than the drill stem.

3. The drill stem guide assembly of claim 1, further comprising:

a control system configured to communicate with the plurality of actuators.

4. The drill stem guide assembly of claim 3,

Wherein the control system is configured to communicate with a limit switch, and wherein the limit switch is triggered by the plurality of covers when the plurality of covers is not in the closed position.

5. The drill stem guide assembly of claim 3, wherein the control system is further configured to control a cutting tool disposed on the drill stem.

6. The drill stem guide assembly of claim 1, further comprising:

a limit switch, disposed on the mounting frame, triggered by the plurality of covers when the plurality of covers is not in the closed position.

7. The drill stem guide assembly of claim 6, wherein the limit switch is configured to communicate with a control system.

8. The drill stem guide assembly of claim 6, wherein the control system is further configured to control a cutting tool disposed on the drill stem.

9. The drill stem guide assembly of claim 1, further comprising:

a shield, disposed on a first cover of the plurality of covers such that the shield overlaps a portion of the first cover and a portion of a second cover of the plurality of covers when the plurality of covers is in the closed position.

10. The drill stem guide assembly of claim 1, further comprising:

a maintenance cradle, removably positionable with the plurality of covers and configured to hold and support a drill stem cutting tool.

11. A drill stem guide assembly for insertion of a drill stem into a coke drum for coke cutting operation, comprising:

a first cover, moveable between an open position and a folded closed position, comprising:

a first guide section a second cover comprising:

a second guide section;

a mounting frame configured to pivotally attach each of the first cover and the second cover to the coke drum; and an actuator mounted with the mounting frame to move the first cover between the open position and the folded closed position, wherein the first guide section and the second guide section form a passageway for guiding the drill stem as the drill stem is moved within the coke drum.

12. The drill stem guide assembly of claim 11, wherein the guide section is made of a material softer than the drill stem.

13. The drill stem guide assembly of claim 11, further comprising:

a control system configured to communicate with the actuator; and a limit switch, which is attached to the mounting frame, configured to communicate with the control system, wherein the limit switch is triggered by the plurality of covers when the plurality of covers is not in the closed position.

14. The drill stem guide assembly of claim 13, wherein the control system is configured to communicate with a high pressure water supply of a drill stem cutting tool.

15. The drill stem guide assembly of claim 11, further comprising:

a shield, disposed on the first cover such that the shield overlaps a portion of the first cover and a portion of the second cover when the first cover is in the closed position.

16. The drill stem guide assembly of claim 11, further comprising:

a maintenance cradle, removably positionable with the first cover and the second cover and configured to hold and support a drill stem cutting tool.

17. A drill stem guide assembly for insertion of a drill stem into a coke drum for coke cutting operations, comprising:

a plurality of covers moveable by folding the covers between an open position and a folded closed position, each of the plurality of covers comprising:

a guide section; and a plurality of actuators configured to communicate with the plurality of covers so as to move the plurality of covers between the open position and the folded closed position, wherein, when the plurality of covers is in the folded closed position, the guide sections of the plurality of covers form a passageway for guiding the drill stem as the drill stem is moved within the coke drum.

18. The drill stem guide assembly of claim 17, wherein the guide section is made of a material softer than the drill stem.

19. The drill stem guide assembly of claim 17, further comprising:

a mounting frame.

20. The drill stem guide assembly of claim 19, a limit switch disposed on the mounting frame, wherein the limit switch, which is triggered by the plurality of covers when the plurality of covers is not in the closed position, is configured to communicate with a control system, wherein the control system is further configured to control a high pressure water supply of a cutting tool disposed on the drill stem.

21. A drill stem guide assembly for insertion of a drill stem into a coke drum for coke cutting operations, comprising:

a plurality of covers moveable by folding the covers between an open position and a folded closed position, each of the plurality of covers comprising:

a guide section; and a plurality of actuators configured to communicate with the plurality of covers so as to move the plurality of covers between the open position and the folded closed position, wherein, when the plurality of covers is in the folded closed position, the guide sections of the plurality of covers form a passageway for guiding the drill stem as the drill stem is moved within the coke drum, further comprising:

a control system configured to communicate with the plurality of actuators, a limit switch disposed on at least one of the plurality of covers, the control system being configured to communicate with the limit switch, wherein the limit switch is configured to signal the control system to shutdown a high pressure water supply of a cutting tool when the limit switch is triggered, wherein the limit switch is triggered when the plurality of covers is not in the closed position.

22. The drill stem guide assembly of claim 17, further comprising:

a shield, disposed on a first cover of the plurality of covers such that the shield overlaps a portion of the first cover and a portion of a second cover of the plurality of covers when the plurality of covers is in the closed position.

23. The drill stem guide assembly of claim 17, further comprising:

a maintenance cradle, removably positionable with the plurality of covers, wherein the maintenance cradle is configured to hold and support a drill stem cutting tool.

24. A coke cutting system comprising:

a plurality of covers moveable by folding the covers between an open position and a folded closed position, each of the plurality of covers comprising:

a guide section;

a mounting frame mounted above the top head of a coke drum configured to pivotally attach the plurality of covers;

a plurality of actuators disposed on the mounting frame to move the plurality of covers between an open position and a folded closed position, wherein, when the plurality of covers is in the folded closed position, the guide sections of the plurality of covers form a passageway for guiding the drill stem as the drill stem is moved within the coke drum to cut the coke and allow free flow of loose coke out of the bottom of the coke drum;

a drill stem adapted for raising and lowering into and out of the coke drum, comprising:

a rotatable nozzle disposed on a end of the drill stem;

a rotation motor attached to the drill stem for rotating the rotatable nozzle;

a winch motor for raising and lowering the drill stem; and a high pressure water supply in fluid communication with the drill stem.

25. The coke cutting system of claim 24, further comprising:

wherein the guide section is made of a material softer than the drill stem.

26. The coke cutting system of claim 24, further comprising:

a control system configured to communicate with the plurality of actuators;

a limit switch configured to communicate with the control system, wherein the limit switch is triggered by the plurality of covers when the plurality of covers is not in the closed position.

27. The coke cutting system of claim 24, wherein the control system is configured to communicate with the high pressure water supply of the rotatable nozzle, wherein the control system is configured to communicate with a drill stem travel limit switch, wherein the drill stem travel limit switch prevents the winch motor from lowering the drill stem if a gate valve is not fully open.

28. The coke cutting system of claim 24, further comprising:

a limit switch disposed on the mounting frame, wherein the limit switch is triggered by the plurality of covers when the plurality of covers is not in the closed position.

29. The coke cutting system of claim 28, wherein the limit switch is configured to communicate with a control system, wherein the control system is configured to communicate with the high pressure water supply of the rotatable nozzle.

30. The coke cutting system of claim 24, further comprising:

a shield, disposed on a first cover of the plurality of covers such that the shield, overlaps a portion of the first cover and a portion of a second cover of the plurality of covers when the plurality of covers are in a non-closed position.

31. The coke cutting system of claim 24, further comprising:

a maintenance cradle, removably positionable with the plurality of covers and configured to hold and support the rotatable nozzle.

* * * * *